US011698237B2

(12) United States Patent
Lipowski

(10) Patent No.: US 11,698,237 B2
(45) Date of Patent: Jul. 11, 2023

(54) REMOVABLE SAFETY SELECTOR FOR FIREARMS

(71) Applicant: 2360216 Ontario Inc., Mississauga (CA)

(72) Inventor: Mats Lipowski, Mississauga (CA)

(73) Assignee: 2360216 ONTARIO, INC., Mississauga (CA)

( * ) Notice: Subject to any disclaimer, the term of this patent is extended or adjusted under 35 U.S.C. 154(b) by 0 days.

(21) Appl. No.: 17/422,337

(22) PCT Filed: Jan. 15, 2020

(86) PCT No.: PCT/CA2020/050038
§ 371 (c)(1),
(2) Date: Jul. 12, 2021

(87) PCT Pub. No.: WO2020/146943
PCT Pub. Date: Jul. 23, 2020

(65) Prior Publication Data

US 2022/0107150 A1 Apr. 7, 2022

Related U.S. Application Data

(60) Provisional application No. 62/793,219, filed on Jan. 16, 2019.

(51) Int. Cl.
*F41A 17/46* (2006.01)
*F41A 35/06* (2006.01)

(52) U.S. Cl.
CPC ..... *F41A 17/46* (2013.01); *F41A 35/06* (2013.01)

(58) Field of Classification Search
CPC ..... F41A 17/46; F41A 35/06
(Continued)

(56) References Cited

U.S. PATENT DOCUMENTS 4,095,363 A * 6/1978 Riedl ..... F41A 17/46 42/23
6,609,319 B1 * 8/2003 Olson ..... F41A 15/14 89/185

(Continued)

OTHER PUBLICATIONS

International Search Report dated Mar. 10, 2020 for International Application No. PCT/CA2020/050038.

(Continued)

*Primary Examiner* — Reginald S Tillman, Jr.
(74) *Attorney, Agent, or Firm* — Tarolli, Sundheim, Covell & Tummino L.L.P.

(57) ABSTRACT

A safety selector comprises a first hub portion, a second hub portion, and a cam portion connecting the first hub portion with the second hub portion. The first hub portion is generally cylindrical in shape, having opposing faces and an longitudinal surface extending therebetween. Further, the first hub portion is segmented in it opposing faces, creating a first plane in the longitudinal surface. The first hub portion further comprises a pair of spaced apart detent sockets in the longitudinal surface face, a connecting groove extending between the detent sockets, and a detent notch in an outer one of the circular faces exposing one of the detent sockets. The cam portion comprises a recessed face and a cam face. The first plane is substantially parallel with the recessed face.

14 Claims, 3 Drawing Sheets

(58) Field of Classification Search
USPC ..... 89/148
See application file for complete search history.

(56) References Cited

U.S. PATENT DOCUMENTS

| | | | |
|---|---|---|---|
| 8,112,930 | B2 | 2/2012 | Sietsema |
| 8,261,424 | B1 | 9/2012 | Thomeczek et al. |
| 8,756,847 | B2 | 6/2014 | Huther |
| 9,557,128 | B2 | 1/2017 | Miller |
| 9,772,156 | B1 | 9/2017 | Viviano |
| 2016/0091268 | A1 | 3/2016 | Miller |
| 2017/0102197 | A1 | 4/2017 | Iosilevsky |
| 2017/0153078 | A1 | 6/2017 | Elftmann |
| 2017/0176122 | A1 | 6/2017 | Underwood |
| 2018/0100712 | A1 | 4/2018 | Tompkins |

OTHER PUBLICATIONS

Partial Search Report dated Sep. 2, 2022, for corresponding EP Application No. 20741542.3.
Extended Search Report dated Dec. 5, 2022, for corresponding EP Application No. 20741542.3.

* cited by examiner

REMOVABLE SAFETY SELECTOR FOR FIREARMS

RELATED APPLICATIONS

The present application is a U.S. National Stage application under 35 USC 371 of PCT Application Serial No. PCT/CA2020/050038, filed on 15 Jan. 2020; which claims priority from U.S. Patent Application No. 62/793,219, filed 16 Jan. 2019, the entirety of both of which are incorporated herein by reference.

The present disclosure relates generally firearms and more specifically to an easily removable safety selector.

BACKGROUND

One successful assault weapon widely distributed in the worldwide market is the fully automatic M16 rifle and its semiautomatic (civilian or sport) version, the AR15. Millions of these rifles and their variants have been produced and continue to be produced and utilized throughout the world.

One significant feature of these rifles is the designed interchangeability of their individual components. Each manufacturer of the AR15 must produce its rifles to meet these interchangeability specifications. That is, the rifle has been designed for maximum interchangeability of the vast majority of the rifle components such that a trigger assembly or a safety selector, for example, from one AR15 can be utilized in a different AR15 simply by swapping the components between the two firearms.

The safety selector in a common AR15-type firearm operates by rotation of a lever 90 degrees from a "safe" position to a "fire" position. In the safe position, an internal shaft of the safety selector blocks movement of a rearwardly extending portion of the trigger member. When rotated to the fire position, a flat or recessed portion of the shaft is positioned over the rearwardly extending portion of the trigger member, allowing actuating movement of the trigger. A spring biased detent pin engages detent sockets with a connecting groove therebetween to limit rotation of the safety selector to 90 degrees and to provide certain positioning in the fire and safe positions.

When removing the safety selector for servicing or replacement, it is required to at least partially disassemble the handle of the firearm. This facilitates retraction of the detent pin and disengagement of the trigger member from the safety selector. The safety selector can then be removed. However, this process can be frustratingly time consuming. Accordingly, the present invention provides a safety selector that improves the ease with which it can be removed from and reinstalled into the firearm.

SUMMARY

In accordance with an aspect of an embodiment, there is provided a safety selector comprising: a first hub portion, a second hub portion, and a cam portion connecting the first hub portion with the second hub portion. The first hub portion is generally cylindrical in shape, having opposing faces and an longitudinal surface extending therebetween. Further, the first hub portion is segmented in it opposing faces, creating a first plane in the longitudinal surface. The first hub portion further comprises a pair of spaced apart detent sockets in the longitudinal surface face, a connecting groove extending between the detent sockets, and a detent notch in an outer one of the circular faces exposing one of the detent sockets. The cam portion comprises a recessed face and a cam face. The first plane is substantially parallel with the recessed face.

In an embodiment, the second hub portion is also generally cylindrical in shape, having opposing faces and an longitudinal surface extending therebetween. The second hub portion segmented along its opposing faces, creating a second plane. The second hub portion further comprises a pair of spaced apart detent sockets in the longitudinal surface face, a connecting groove extending between the detent sockets, and a detent notch in an outer one of the circular faces exposing one of the detent sockets. The connecting groove in the second hub portion has a different length to the connecting groove in the first hub portion. The cam portion comprises a second recessed face substantially parallel with the second plane.

In accordance with another aspect of an embodiment, there is provided a detent pin for use with a safety selector in a firearm, the detent pin comprising: a body configured to be connected to a receiver of the firearm, and a ball tip configured to interface with the safety selector.

BRIEF DESCRIPTION OF THE DRAWINGS

Embodiments of the invention will be described by way of example only with reference to the following drawings in which.

DETAILED DESCRIPTION OF THE PREFERRED EMBODIMENTS

Figure 1:
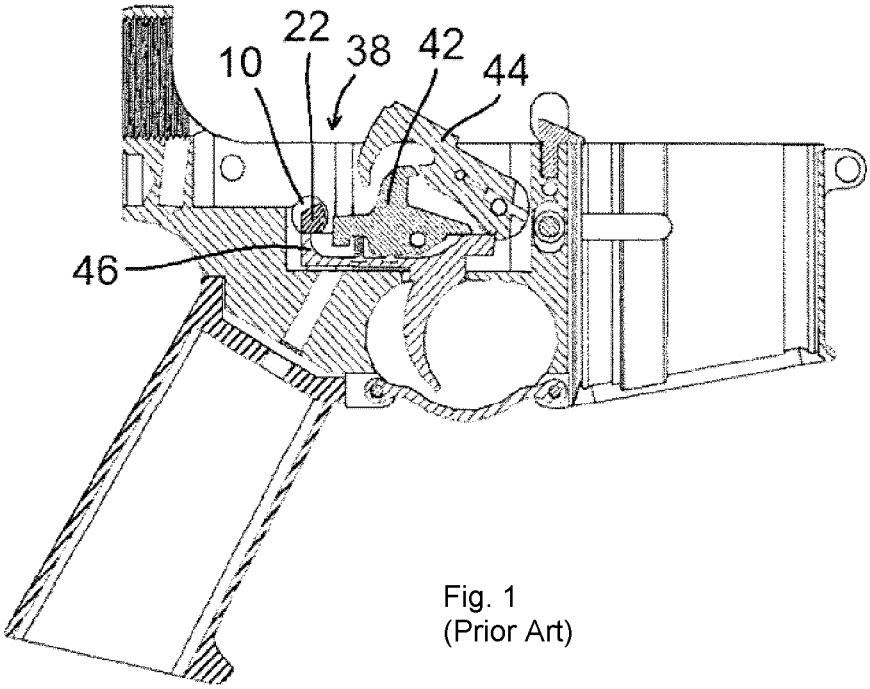
Fig. 1 (Prior Art)
FIG. 1 is a side view of a lower receiver of an AR15 (prior art)

For convenience, like numerals used in the description refer to like structures in the drawings. Referring to FIG. 1, a lower receiver of a common AR15-type firearm is illustrated generally by reference numeral 38. The receiver 38 includes a fire control mechanism comprising a trigger 40, a disconnector 42, a hammer 44, and associated springs (not shown), the operation of which is well-known in the art. The trigger 40 includes a rearwardly-extending portion 46. A safety selector 10 is engaged with the rearwardly-extending portion 46 of the trigger 40, thereby inhibiting pivotal movement of the trigger 40. Accordingly, it will be appreciated that the safety selector 10 is illustrated in a "safe" position.

Figure 2:
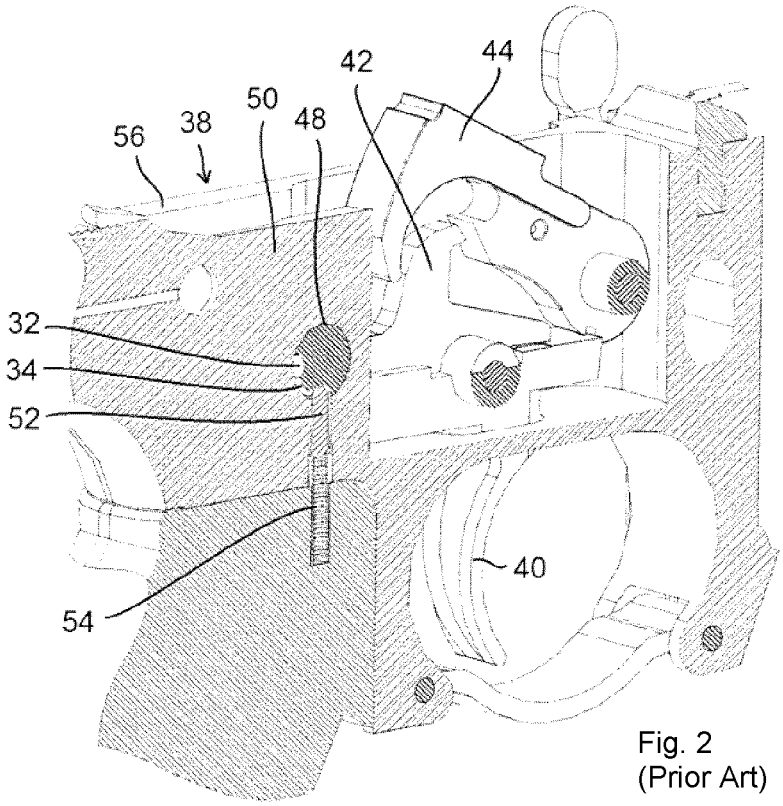
Fig. 2 (Prior Art)
FIG. 2 is a perspective view of the lower receiver shown in FIG. 1 (prior art)

Referring to FIG. 2, an isometric of the lower receiver 38 is shown. As illustrated, lower receiver includes a pair of opposing walls 50 and 56. Within each wall is a pair of opposing openings 48. Within the right side wall 50 of the receiver 38, there is a detent pin 52 that is biased upwardly by a spring 54. The detent pin 52 is positioned to engage detent sockets 32 and connecting grooves 34. As shown in FIG. 2, the detent pin 52 will engage the detent sockets 32 with a throw of 90 degrees between the safe and fire positions.

Figure 3:
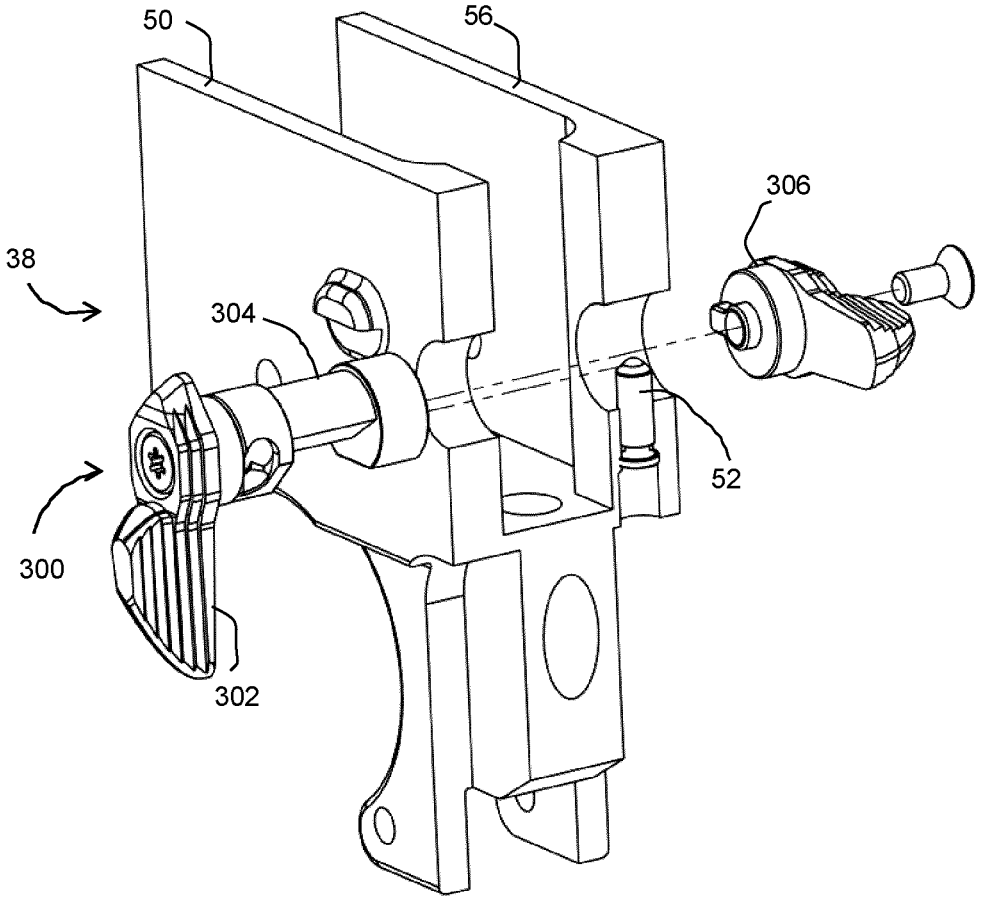
FIG. 3 is a perspective view of a safety selector in accordance with an embodiment.

Referring to FIG. 3, a safety selector in accordance with an embodiment of the present invention is illustrated generally by numeral 300. The safety selector 300 comprises a first operating lever 302, a pivotable shaft 304, and a second operating lever 306. One or both of the levers 302 and 306 may be disassembled from the shaft 304 for installation. That is, one or both of the operating levers 302 and 306 may be detachably coupled to the shaft 304 by a threaded fastener, for example, of well-known configuration.

Figure 4:
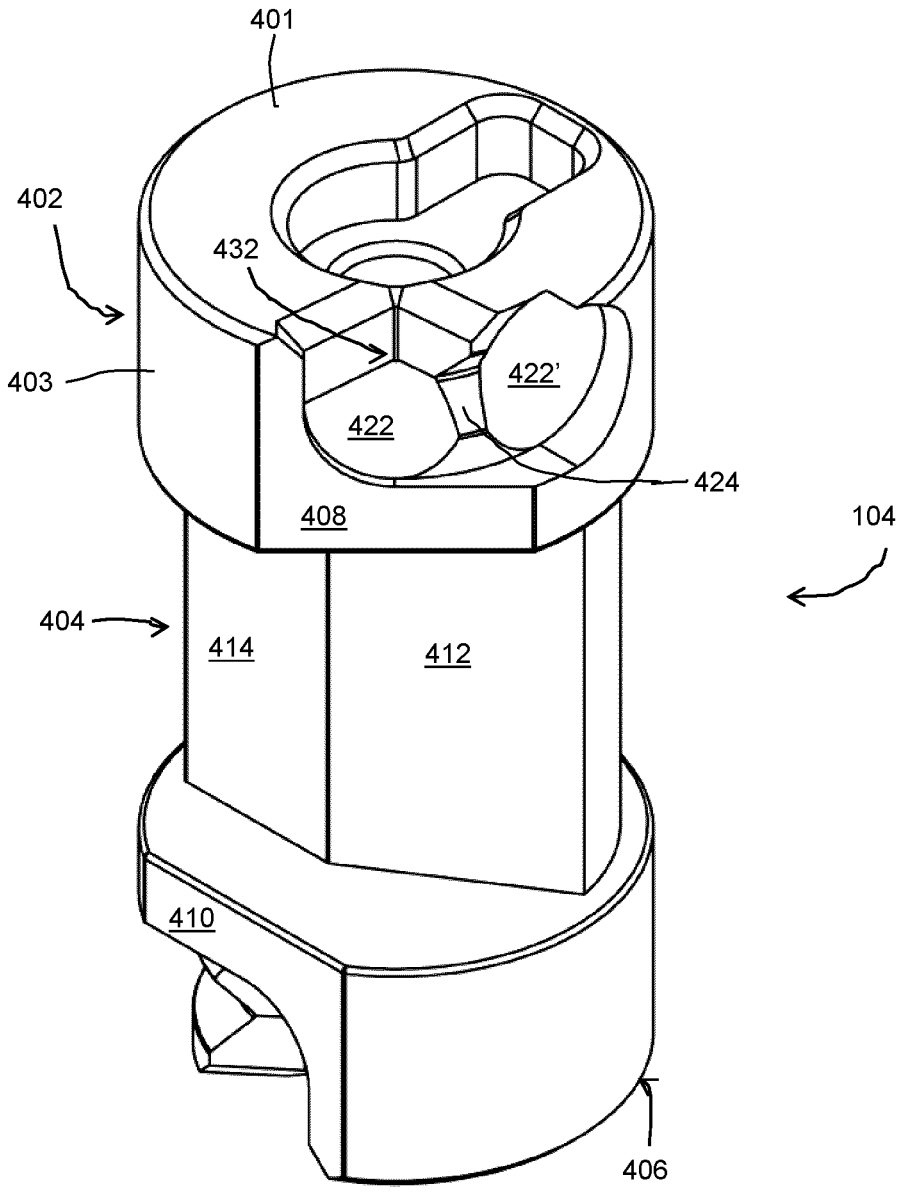
FIG. 4 is a perspective view of the shaft of the safety selector illustrated in FIG. 3.

Referring to FIG. 4, the shaft 304 of the safety selector 300 is illustrated in greater detail. The shaft includes a first hub portion 402 at one end thereof and a second hub portion 406 at the opposite end thereof. The first hub portion 402 and the second hub portion 406 are connected by a cam portion 404 having recessed planar faces 412 and 414. The cam portion 404 also comprises a cam face (not shown) configured to block movement of the fire control mechanism.

The first hub portion 402 is generally cylindrical in shape. The first hub portion comprises opposing faces 401 and an longitudinal surface 403 extending therebetween. In an embodiment, the opposing faces are circular. The first hub portion is segmented in its circular faces 401, creating a first plane 408 in the longitudinal surface 403. Accordingly, it will be appreciated that the longitudinal surface 403 is flat in the first plane 408 and curved elsewhere. In an embodiment, the first hub portion is segmented in the circular faces 401 along a chord.

The first hub portion 402 includes a pair of detent sockets 422 and 422' in the longitudinal surface of the first hub portion 402. A connecting groove 424 extends between the pair of detent sockets 422 and 422'. The pair of detent sockets 422 and 422' are positioned proximal an outer one of the circular faces of the first hub portion 402. The first hub portion 402 further includes a detent notch 432 in the outer circular face, thereby exposing a first one 422 of the pair of detent sockets. In an embodiment, the first detent socket 422 is in the first plane and the second detent socket 422' is in the curved surface of the longitudinal plane.

Similarly, the second hub portion 406 is generally cylindrical in shape and segmented in its opposing faces, creating a second plane 410 in its longitudinal surface. In an embodiment, the second hub portion is segmented in the circular faces along a chord. The second hub portion 406 includes a pair of detent sockets (not shown) in the longitudinal surface of the second hub portion 406. A connecting groove (not shown) extends between the pair of detent sockets (not shown). The pair of detent sockets are positioned proximal the outer circular face of the second hub portion 406. The second hub portion 406 further includes a detent notch (not shown) in the outer circular face, thereby exposing a first one of the pair of detent sockets. In an embodiment, the first detent socket is in the second plane and the second detent socket is in the curved surface of the longitudinal plane.

In an embodiment, each of the connecting grooves is coated with a ceramic material, such as silicon nitride for example, to improve the smoothness with which the detent pin 52 travels between the pair of detent sockets.

The length of each connecting groove works in concert with a corresponding one of the recessed planar faces 412 and 414 to provide a throw of either 90 degrees or 45 degrees, depending on the orientation of the safety selector 300. In an example embodiment, the first hub portion 402 has a short connecting groove 424 connecting the detent sockets 422 and 422'. The first hub portion 402 works in concert with the recessed face 412 to provide a throw of 45 degrees. The second hub portion 406 has a long connecting groove connecting the detent sockets. The second hub portion 406 works in concert with the recessed face 414 to provide a throw of 90 degrees.

The first plane 408 in the first hub portion 402 is substantially parallel with the first recessed face 412. The second plane 410 in the second hub portion 406 is substantially parallel with the second recessed face 414. As will be described below, using a cylindrical section for the first and second hub portions 402 and 406, rather than a complete cylinder, along with the detent notches facilitates easy removal and insertion of the safety selector 300.

Referring once again to FIGS. 2 and 3, insertion of the safety selector 300 is accomplished as follows. For ease of explanation, it is assumed that the both the first operating lever 302 and the second operating lever 306 are detachably coupled with the first hub portion 402 and the second hub portion 406, respectively. Once a desired throw is selected, the safety selector 300 is inserted accordingly. Thus, for example, if a throw of 45 degrees is desired, the first operating lever 302 is disconnected from the first hub portion 402. The first hub portion 402 is passed through the opening 48 in the left side wall 56 of the receiver. The first hub portion 402 is positioned so that the first plane 408 passes proximal the rearwardly-extending portion 46 of the trigger 40. Once the first hub portion 402 reaches the opening 48 in the right side wall 50, the detent pin 52 passes through the detent notch 432 and into the first detent socket 422. The safety selector 300 is fixed in place by re-connecting the first operating lever 302 to the first hub portion 402.

As will be appreciated, the missing section of the first hub portion 402 allows it to pass by the rearwardly-extending portion 46 of the trigger 40, without manipulation of the trigger. Further, the detent notch 432 allows the first hub portion 402 to pass over the detent pin 52 and engage it with the first detent socket 422, without removal of the detent pin 52. Thus, it is not necessary to partially disassemble the handle of the firearm when replacing the safety selector 300.

If for example, if a throw of 90 degrees is desired, the second operating lever 306 is disconnected from the second hub portion 406. The second hub portion 406 is passed through the opening 48 in the left side wall 56 of the receiver. The second hub portion 406 is positioned so that the second plane 410 passes proximal the rearwardly-extending portion 46 of the trigger 40. Once the second hub portion 406 reaches the opening 48 in the right side wall 50, the detent pin 52 passes through the detent notch and into the first detent socket. The safety selector 300 is fixed in place by re-connecting the second operating lever 306 to the second hub portion 406.

Similarly, in this example the missing section of the second hub portion 406 allows it to pass by the rearwardly-extending portion 46 of the trigger 40, without manipulation of the trigger. Further, the detent notch allows the second hub portion 406 to pass over the detent pin 52 and engage it with the first detent socket, without removal of the detent pin 52. Thus, it is not necessary to partially disassemble the handle of the firearm when replacing the safety selector 300.

Although the examples above are described with reference to a specific embodiment, various modifications can be made without departing from the scope of the invention. For example, although the safety selector 300 described is a reversible safety selector that provides the ability to select between a 90 degree throw and a 45 degree throw, the safety selector may provide a single throw. In such an example, only one recessed face is provided on the shaft 304. Further, only one of the hub portions comprises both the segmented cylinder and the detent notch. In such an example, one of the operating levers 302 or 306 may be formed integrally with the shaft 304 and the other lever 306 or 302 would be detachably connected thereto. In such an example, the integral lever is attached to the hub portion that does not include the chord plane and the detent notch.

The attachment between the operating lever 306 and the shaft 304 may include an interlocking configuration such as a tongue and groove or a dove tail attachment, for example. Both of these attachment means are well known, but the exact nature and interlocking means is not important to the present invention.

As another example, it is not required to have two operating levers coupled with the safety selector 300. Rather, instead of a second operating lever, a threaded cap could be used to secure the safety selector 300 in place.

Although the previous examples describe the detent pin 52 as being situated within the right side wall 50 of the receiver 38, this is a result of the specification for an AR15-type firearm. The previous example can easily be implement with the detent pin 52 being situated within the left side wall 56 of the received 38, if it is so desired.

Figure 5:
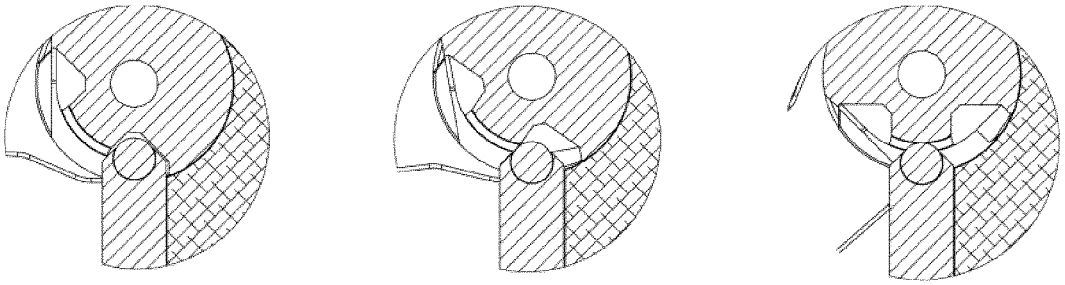
FIG. 5 is a cross-sectional view of a detent pin interacting with the safety selector in accordance with an aspect of an embodiment.

In a previous embodiment, the connecting grooves were coated with a ceramic to reduce friction between the connecting grooves and the detent pin, as the safety selector traveled between the safe and fire positions. This provides the user with more smooth feedback when changing positions. In order to further reduce the friction, in an embodiment the standard detent pin is replaced with a detent pin having a ceramic material ball tip as illustrated in FIG. 5. Similar to the connecting grooves, the ceramic material is a material such as silicon nitride, for example. In one example, the ball tip is stationary. In another example, the ball tip rotates in place, thus further reducing the friction with the connecting groove.

While the examples described above are directed to a safety selector for an AR15-type firearm, those skilled in the art will appreciate that it can be implemented on other models firearms, as appropriate.

The scope of the appended claims should not be limited by the preferred embodiments set forth in the examples but should be given the broadest interpretation consistent with the description as a whole.

What is claimed is:

1. A safety selector comprising:

a first hub portion generally cylindrical in shape having opposing faces and a longitudinal surface extending therebetween, the first hub portion segmented along the faces, creating a first plane in the longitudinal surface, the first hub portion comprising:

a pair of spaced apart detent sockets in the longitudinal surface;

a connecting groove extending between the detent sockets; and a detent notch in an outer one of the faces exposing one of the detent sockets;

a second hub portion; and a cam portion connecting the first hub portion with the second hub portion, the cam portion comprising:

a recessed face; and a cam face;

wherein the first plane is substantially parallel with the recessed face.

2. The safety selector of claim 1, further comprising an operating lever coupled to the second hub portion.

3. The safety selector of claim 2, wherein the operating lever is detachably coupled to the second hub portion.

4. The safety selector of claim 2, further comprising a second operating lever detachably coupled to the first hub portion.

5. The safety selector of claim 2, further comprising a threaded cap detachably coupled to the first hub portion.

6. The safety selector of claim 1, wherein the second hub portion is generally cylindrical in shape having opposing faces and a longitudinal surface extending therebetween, the second hub portion segmented along the faces, creating a second plane, the second hub portion comprising:

a pair of spaced apart detent sockets in the longitudinal surface;

a connecting groove extending between the detent sockets; and a detent notch in an outer one of the faces exposing one of the detent sockets;

wherein the connecting groove in the second hub portion and the connecting groove in the first hub portion have different lengths; and wherein the cam portion comprises a second recessed face substantially parallel with the second plane.

7. The safety selector of claim 6, wherein the exposed one of the detent sockets in the second hub portion is in the second plane.

8. The safety selector of claim 7, wherein the other one of the detent sockets in the second hub portion is in a curved portion of the longitudinal surface.

9. The safety selector of claim 6, further comprising a ceramic coating along the connecting groove of the second hub portion.

10. The safety selector of claim 1, wherein the exposed one of the detent sockets in the first hub portion is in the first plane.

11. The safety selector of claim 10, wherein the other one of the detent sockets in the first hub portion is in a curved portion of the longitudinal surface.

12. The safety selector of claim 1, further comprising a ceramic coating along the connecting groove of the first hub portion.

13. A detent pin for use with a safety selector in a firearm, the detent pin comprising:

a body configured to be connected to a receiver of the firearm, and a ball tip configured to interface with the safety selector, wherein the ball tip is stationary.

14. The detent pin of claim 13, wherein the ball tip is a ceramic material.

* * * * *